US009790881B2

(12) United States Patent
Kopecek et al.

(10) Patent No.: US 9,790,881 B2
(45) Date of Patent: Oct. 17, 2017

(54) INTERNAL COMBUSTION ENGINE

(71) Applicant: GE Jenbacher GmbH & Co OG, Jenbach (AT)

(72) Inventors: Herbert Kopecek, Schwaz (AT); Nikolaus Spyra, Innsbruck (AT)

(73) Assignee: GE Jenbacher GMBH & CO OG, Jenbach (AT)

( * ) Notice: Subject to any disclaimer, the term of this patent is extended or adjusted under 35 U.S.C. 154(b) by 0 days.

(21) Appl. No.: 14/730,670

(22) Filed: Jun. 4, 2015

(65) Prior Publication Data

US 2015/0361912 A1 Dec. 17, 2015

(30) Foreign Application Priority Data

Jun. 12, 2014 (AT) ..... A 466/2014

(51) Int. Cl.
*F02D 41/00* (2006.01)
*F02D 41/14* (2006.01)
(Continued)

(52) U.S. Cl.
CPC ..... *F02D 41/1446* (2013.01); *F02D 13/0223* (2013.01); *F02D 17/02* (2013.01);
(Continued)

(58) Field of Classification Search
CPC ..... F02D 41/1446; F02D 41/3005; F02D 41/0027; F02D 41/0087; F02D 13/0223;
(Continued)

(56) References Cited

U.S. PATENT DOCUMENTS 3,158,143 A * 11/1964 Heidner ..... F02M 1/00 123/198 D
4,134,261 A * 1/1979 Iizuka ..... F02D 17/02 60/276

(Continued)

FOREIGN PATENT DOCUMENTS

AU 763652 7/2003
DE 29 28 075 2/1981

(Continued)

OTHER PUBLICATIONS

European Search Report dated Oct. 16, 2015 (with English translation).

(Continued)

*Primary Examiner* — Hieu T Vo
*Assistant Examiner* — Sherman Manley
(74) *Attorney, Agent, or Firm* — GE Global Patent Operation

(57) ABSTRACT

An internal combustion engine comprising: a plurality of cylinders in which combustion chambers are provided, wherein an ignition device and/or a fuel introduction device is associated with each combustion chamber, wherein the combustion chambers are adapted for cyclic ignition of fuel, an open-loop or closed-loop control device for actuation or closed-loop control of the ignition devices and/or fuel introduction devices, and at least one measuring device for detecting a temperature which is characteristic for each cylinder, wherein the open-loop or closed-loop control device is adapted for actuation or closed-loop control of the ignition devices or the fuel introduction devices in dependence on the signals of the at least one measuring device so that no ignition takes place in at least one selected cylinder during at least one cycle and that an even temperature distribution over all cylinders is achieved.

9 Claims, 5 Drawing Sheets

(51) Int. Cl.

| | |
|---|---|
| ***F02D 17/02*** | (2006.01) |
| ***F02D 13/02*** | (2006.01) |
| ***F02D 17/04*** | (2006.01) |
| ***F02D 41/30*** | (2006.01) |
| ***F02P 5/145*** | (2006.01) |

(52) U.S. Cl.
CPC ..... *F02D 17/04* (2013.01); *F02D 41/0027* (2013.01); *F02D 41/0087* (2013.01); *F02D 41/3005* (2013.01); *F02P 5/1455* (2013.01); *F02D 2200/021* (2013.01); *F02D 2250/18* (2013.01)

(58) Field of Classification Search
CPC .... F02D 17/04; F02D 17/02; F02D 2200/021; F02D 2250/18; F02P 5/1455
See application file for complete search history.

(56) References Cited

U.S. PATENT DOCUMENTS

| | | | | |
|---|---|---|---|---|
| 4,257,372 | A * | 3/1981 | Etoh | B01D 53/9495 123/198 F |
| 4,263,782 | A * | 4/1981 | Matsumoto | F01N 3/20 123/198 F |
| 4,473,045 | A * | 9/1984 | Bolander | F01P 11/14 123/198 D |
| 4,941,442 | A * | 7/1990 | Nanyoshi | F02D 41/0087 123/333 |
| 4,966,115 | A * | 10/1990 | Ito | F02P 5/1504 123/198 DC |
| 5,502,966 | A | 4/1996 | Unland et al. | |
| 5,555,871 | A * | 9/1996 | Gopp | F02B 75/22 123/198 D |
| 5,813,383 | A | 9/1998 | Cummings | |
| 5,816,220 | A | 10/1998 | Stumpp et al. | |
| 6,557,505 | B1 | 5/2003 | Hori | |
| 7,167,789 | B1 | 1/2007 | Froloff et al. | |
| 7,188,468 | B2 | 3/2007 | Fukusako et al. | |
| 7,204,235 | B1 * | 4/2007 | Gebby | F02D 13/06 123/198 F |
| 7,577,511 | B1 | 8/2009 | Tripathi et al. | |
| 7,849,835 | B2 | 12/2010 | Tripathi et al. | |
| 7,886,715 | B2 | 2/2011 | Tripathi et al. | |
| 7,954,474 | B2 | 6/2011 | Tripathi et al. | |
| 8,099,224 | B2 | 1/2012 | Tripathi et al. | |
| 8,131,445 | B2 | 3/2012 | Tripathi et al. | |
| 8,131,447 | B2 | 3/2012 | Tripathi et al. | |
| 2002/0120384 | A1 | 8/2002 | Takemura et al. | |
| 2005/0022509 | A1 | 2/2005 | Fukusako et al. | |
| 2010/0010724 | A1 | 1/2010 | Tripathi et al. | |
| 2010/0037857 | A1 | 2/2010 | Tripathi et al. | |
| 2010/0050985 | A1 | 3/2010 | Tripathi et al. | |
| 2010/0050986 | A1 | 3/2010 | Tripathi et al. | |
| 2011/0208405 | A1 | 8/2011 | Tripathi et al. | |
| 2011/0213540 | A1 | 9/2011 | Tripathi et al. | |
| 2011/0213541 | A1 | 9/2011 | Tripathi et al. | |
| 2013/0289853 | A1 | 10/2013 | Serrano | |

FOREIGN PATENT DOCUMENTS

| | | |
|---|---|---|
| DE | 43 10 261 | 10/1994 |
| DE | 195 36 109 | 4/1997 |
| JP | 60-195341 | 10/1985 |
| JP | 61-31647 | 2/1986 |
| JP | 7-63148 | 3/1995 |
| JP | 2000-8892 | 1/2000 |
| JP | 2002-256930 | 9/2002 |
| JP | 2005-9364 | 1/2005 |
| JP | 2013-224669 | 10/2013 |
| SU | 767381 | 9/1980 |

OTHER PUBLICATIONS

Austrian Search Report (ASR) dated Dec. 17, 2014 in Austrian Patent Application No. A 466/2014.

* cited by examiner

INTERNAL COMBUSTION ENGINE

BACKGROUND OF THE INVENTION

1. Field of the Invention

The present invention concerns an internal combustion engine and a method of operating an internal combustion engine in which excessive mechanical loadings and/or wear are avoided by skip firing.

The individual combustion chambers of the internal combustion engine are in the form of piston-cylinder units (for brevity, often referred to as the cylinders). Depending on the respective type of internal combustion engine, the combustion chambers can be subdivided into prechambers and main combustion chambers. In that case, the ignition device is generally associated with the prechamber.

For various reasons, it may be desirable for cylinders of the internal combustion engine to be at least temporarily selectively shut down or deactivated, which in the context of the present application is to be interpreted as meaning that the respective ignition device and/or the device for introducing fuel remains inactive.

2. Description of the Related Art

Methods of cylinder deactivation, referred to as 'skip firing', are known from the state of the art. Skip firing is used predominantly in larger engines with more than six cylinders in order to reduce the fuel consumption and emissions when there is a reduced demand for power.

DE 43 10 261, for example, describes that patterns for selective skip firing (referred to in the specification as deactivation patterns) can be predetermined to protect an engine from overloading. The patterns are advantageously matched to the number of cylinders such that there are circulating deactivation sequences, that is to say, each cylinder is relieved of load within a very short time.

It is further known from DE 2928075 that the sequence of commands for ignition and for skip firing is selected such that the internal combustion engine runs as smoothly as possible, and in particular, harmonics of the resonance frequencies of the engine suspension and the drivetrain are avoided.

US 2013/0289853 describes a method of skip firing, wherein ignition commands are stored in a reference table (referred to as the look-up table) and the entry for the next ignition command is determined by means of a counter in the look-up table.

SUMMARY OF THE INVENTION

The object of the invention is to provide an internal combustion engine and a method of operating an internal combustion engine, in which excessive mechanical loadings and/or wear are avoided by skip firing.

The fact that an open-loop or closed-loop control device is adapted to actuate or regulate ignition devices or fuel introduction devices in dependence on signals of at least one measuring device for detecting a temperature which is characteristic for each cylinder so that no ignition takes place in at least one selected cylinder during at least one cycle means that it is possible to achieve a more uniform thermal condition for the internal combustion engine. That involves a number of advantages:

A thermally more uniform condition results in a lower mechanical loading and less wear on the internal combustion engine. The lubricant management is improved as there is a lower level of heat input into the lubricant circuit.

In the present disclosure, the term 'fuel' is used to mean either pure fuel, for example, combustion gas, or a fuel-air mixture. The term 'cycle' is used to denote an operating cycle of the engine, that is to say in the case of a four-stroke engine, a crankshaft rotation of 720°, in the case of a two-stroke engine, a crankshaft rotation of 360°, wherein 360° corresponds to a full angle.

In the context of the present application, the term 'ignition' is also used to mean 'combustion', that is to say, when 'no ignition takes place in a cycle', that means that there is no combustion of the mixture in that cycle, that is to say, the respective ignition device and/or fuel introduction device remains inactive.

The characteristic temperature can be, for example, an exhaust gas temperature, a temperature in the cylinder itself, a temperature of a connecting rod bearing or of individual parts of the cylinder (for example, a cylinder head, a fire plate, a piston or a liner). The sensors are to be correspondingly arranged in the internal combustion engine, as is familiar to one skilled in the art.

It can preferably be provided that the open-loop or closed-loop control device is adapted to actuate or regulate the fuel introduction device of the at least one selected cylinder during the at least one cycle so that the introduction of fuel into the at least one selected cylinder is interrupted. In that case, an ignition device which is possibly provided can remain active or switched on as in any case there is no ignitable fuel in the combustion chamber.

Additionally or alternatively, it can be provided that the open-loop or closed-loop control device is adapted to deactivate or not activate the ignition device of the at least one selected cylinder during the at least one cycle. In that case, it can even be provided that a fuel introduction device which is possibly provided remains active or switched on as fuel in the combustion chamber is not ignited.

The fuel introduction devices can be, for example, in the form of port injection valves, in the form of variable inlet valves of a variable valve gear or in the form of injectors arranged directly in the cylinder. The injectors can be adapted for direct injection of fuel in an Otto cycle engine or for the injection of diesel in a diesel engine.

The ignition devices—insofar as they are present—can be, for example, in the form of spark ignition devices, corona ignition devices, glow plugs or also in the form of laser ignition devices.

A further preferred embodiment of the invention provides that stored in an electronic memory of the open-loop or closed-loop control device is a baseline pattern, in accordance with which the ignition devices and/or the fuel introduction devices are actuable or regulatable by the open-loop or closed-loop control device in such a way that no ignition occurs in at least one selected cylinder during at least one cycle, wherein the open-loop or closed-loop control device is adapted in a first operating mode to actuate or regulate the ignition device and/or fuel introduction devices without taking account of the signals of the at least one measuring device in accordance with the baseline pattern. The baseline pattern can be selected such that the sequence of ignitions or omissions gives a distribution which is as uniform as possible of the mechanical and thermal load on the engine, as is already known from the state of the art. The baseline pattern for cylinder deactivation can be matched to the currently prevailing power requirement of the internal combustion engine.

It is particularly preferably provided that the open-loop or closed-loop control device is adapted in the situation where the characteristic temperature of at least one of the cylinders reaches or exceeds a predeterminable upper value to actuate or regulate said cylinder in such a way that no ignition occurs. In the situation where, as described above, in a first operating mode, operation is implemented in accordance with a baseline pattern, that measure can be provided as a second operating mode to which the system changes from the first operating mode. That provides that a cylinder with a particularly high characteristic temperature is excluded from ignition and in that way, the thermal load on the corresponding cylinder is reduced.

Particularly preferably, it is provided that the open-loop or closed-loop control device is adapted in the situation where the characteristic temperature of at least one of the cylinders reaches or falls below a predeterminable lower value to actuate or regulate said cylinder in such a way that ignition occurs. That measure can be implemented in isolated form or in combination with one of the above-described measures. That provides that a cylinder with a particularly low characteristic temperature is not excluded from ignition, therefore has ignition as from the next cycle, and as a result, the thermal load on the corresponding cylinder is increased.

As an example, it can also be provided that the upper and/or lower value is established based on the average temperature of all cylinders (or in a variant on only selected cylinders, for example, only that cylinder of a cylinder bank).

The average temperature can be determined by way of the arithmetic mean value or median. The upper and lower limit are calculated from the average temperature and an offset. The offset can be selected in different ways, depending on how many cylinders are intended for non-ignition. The offset therefore corresponds to the band of deviation in relation to the average temperature, above which the cylinder in question receives the command for non-ignition and below which the cylinder in question receives the command for ignition. To illustrate that with a numerical example: let the average temperature of the temperatures ascertained directly at the outlet valve be 350° C. and let the offset be selected as 100° C. Then the upper limit, upon the attainment of which the cylinder in question receives the command for non-ignition, is at 450° C. The lower limit, at the attainment of which the cylinder in question receives the command for ignition, is then at 250° C. The offset therefore establishes the width of the band in which the individual cylinder temperatures may occur before their ignition status is altered. It is possible for it to be selected to be narrower, for example 30-40° C., which results in many regulating interventions with respect to the ignition status of the cylinder. When the band is selected to be wider, that is to say by virtue of a greater offset, the cylinder temperatures can deviate more greatly from each other. The aim of the measure, however, is to keep the cylinder temperatures in a band which is as tight as possible, that is to achieve an even temperature distribution over all cylinders. In practice, the offset would be selected asymmetrically in relation to the average temperature, that is to say, for example, the lower offset which establishes the lower temperature limit of a cylinder is selected to be of greater magnitude than the upper offset which establishes the upper temperature limit of a cylinder.

It is particularly preferably provided that besides the signals from the measuring device further signals which are characteristic for the rotary speed and the load presetting to the internal combustion engine can also be fed to the open-loop or closed-loop control device and the open-loop or closed-loop control device is adapted in dependence on the further signals to establish what proportion of the overall cylinders present involves ignition. That takes into account the fact that the omission of cylinders should naturally only occur to an extent which is matched to the currently prevailing load or speed requirement to the engine. That means, for example, that no ignition omission is to occur under full load on the internal combustion engine.

If, for example, the presetting for maintaining a rotary speed or a power output requires a higher number of cylinders with ignition taking place per cycle than is currently provided, then preferably such cylinders are actuated or regulated for ignition by the open-loop or closed-loop control device, that in comparison with the other cylinders involve a lower characteristic temperature.

If, for example, the presetting for maintaining a rotary speed or a power output requires a lower number of cylinders involving ignition per cycle than is currently provided, then preferably those cylinders are added for ignition, that in comparison with the other cylinders involve a higher characteristic temperature.

Particularly preferably, it is provided that the open-loop or closed-loop control device is adapted, in the event of failure of a signal of the temperature which is characteristic for a cylinder, to actuate or regulate said cylinder with respect to an ignition thereof corresponding to a predetermined number of past cycles. That ensures that, upon failure of a sensor, the corresponding cylinder is fired in accordance with the past cycles.

The upper and/or lower value can be established based on the average temperature of all or selected cylinders. In that case, the average temperature can be determined by way of the arithmetic mean value or median. It is possible to form sub-groups, for example, a respective cylinder bank, to which the algorithm is applied.

As the method, it is provided that the deactivation of at least one cylinder is effected in dependence on the characteristic temperature of that at least one cylinder. The design options described in relation to the apparatus also apply here.

BRIEF DESCRIPTION OF THE DRAWINGS

Further details and advantages of the invention will be apparent from the Figures and the related specific description.

Figure 1:
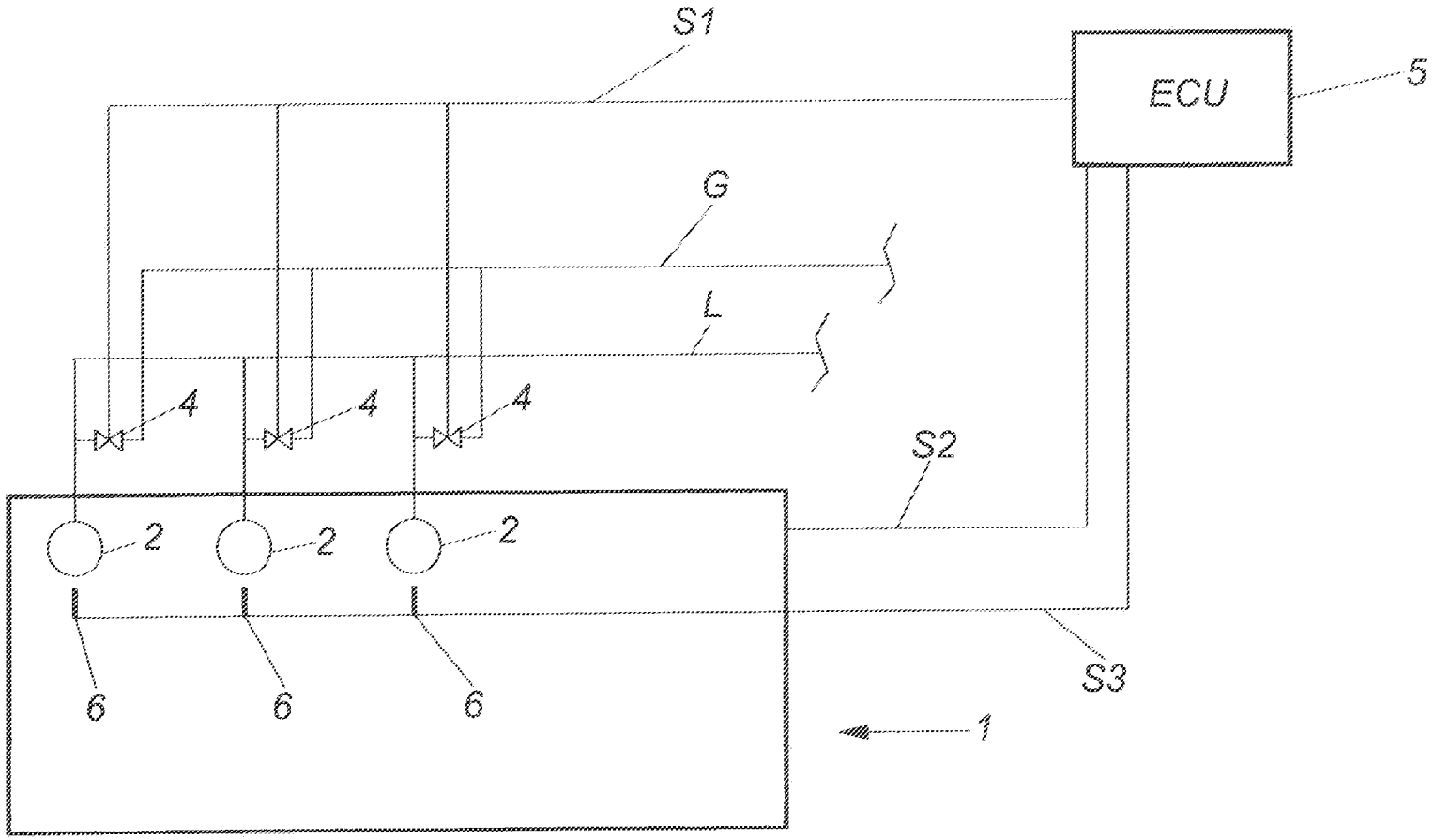
FIG. 1 diagrammatically shows the circuit diagram and line diagram of an internal combustion engine 1. The internal combustion engine 1 has a plurality of cylinders 2 which can be supplied with fuel by way of fuel introduction devices 4. For the sake of clarity of the drawing, only three cylinders 2 are shown. By way of the temperature signal line S3, the open-loop or closed-loop control device 5 receives signals from the sensors 6 of the measuring device for determining the characteristic temperature of the cylinders 2, information relating to the characteristic temperature of the cylinders 2, and also by way of the signal line S2, signals which are characteristic of the power and speed of the internal combustion engine 1.

Ignition devices 3 are not shown in FIG. 1, but can obviously be present. The open-loop or closed-loop control device 5 can send commands for the introduction of fuel to the fuel introduction devices 4 by way of the fuel feed signal line S1. The fuel feed is effected by way of the fuel feed line G. The feed of air is effected separately here through the air feed line L.

This embodiment is relevant, for example, for internal combustion engines which are equipped with a port-injection system or a variable valve gear.

Figure 2:
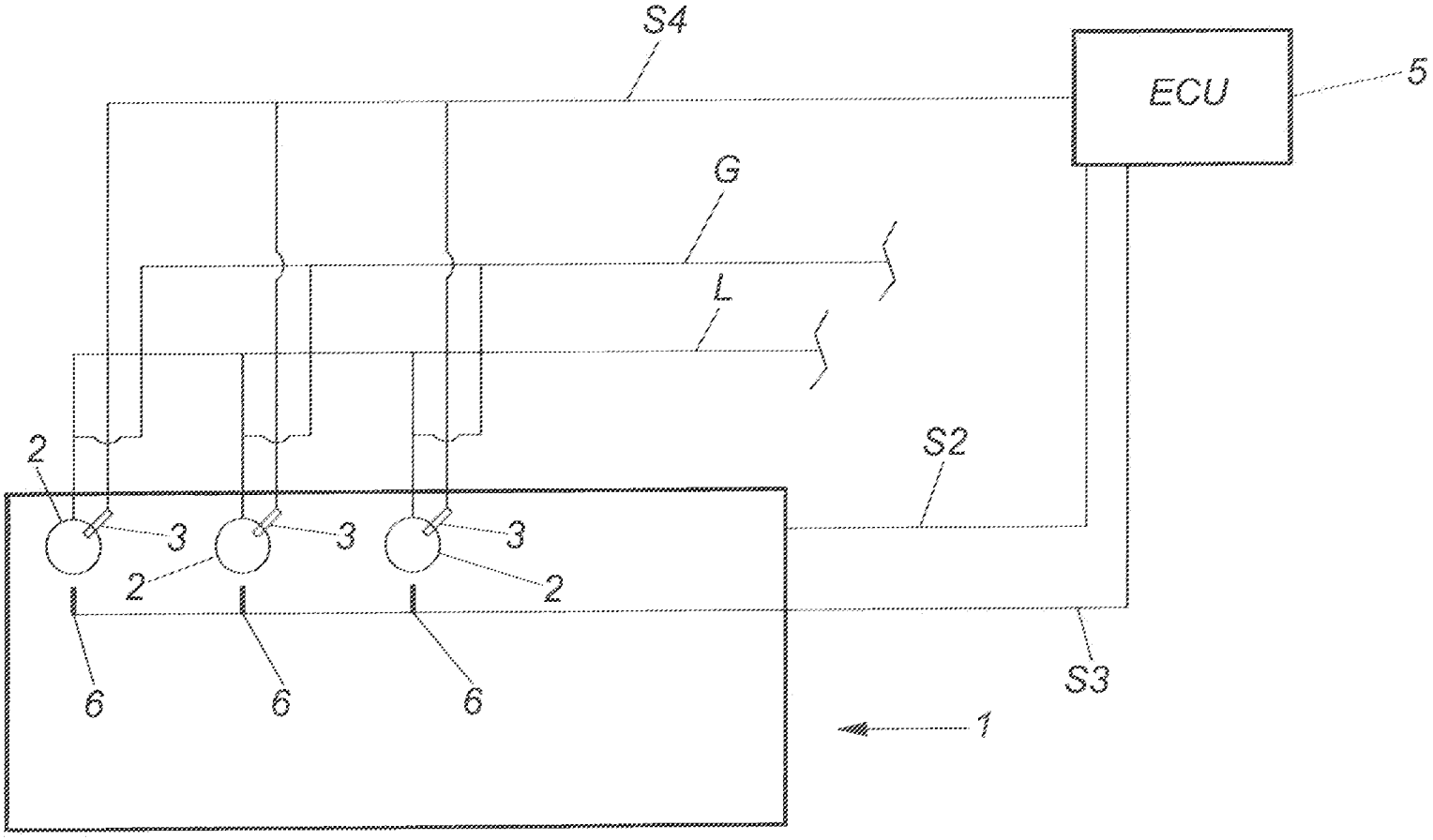

FIG. 2 diagrammatically shows the circuit diagram and line diagram of an internal combustion engine 1 as shown in FIG. 1, wherein ignition devices 3 are shown. As described in FIG. 1, the open-loop or closed-loop control device 5 receives signals from the sensors 2 of the measuring device for determining the characteristic temperature of the cylinders 2 and also further signals from further sensors (not shown) which are characteristic of the power output and speed of the internal combustion engine 1. The open-loop or closed-loop control device 5 can pass commands for ignition or non-ignition to the ignition devices by way of the ignition signal line S4.

Figure 3:
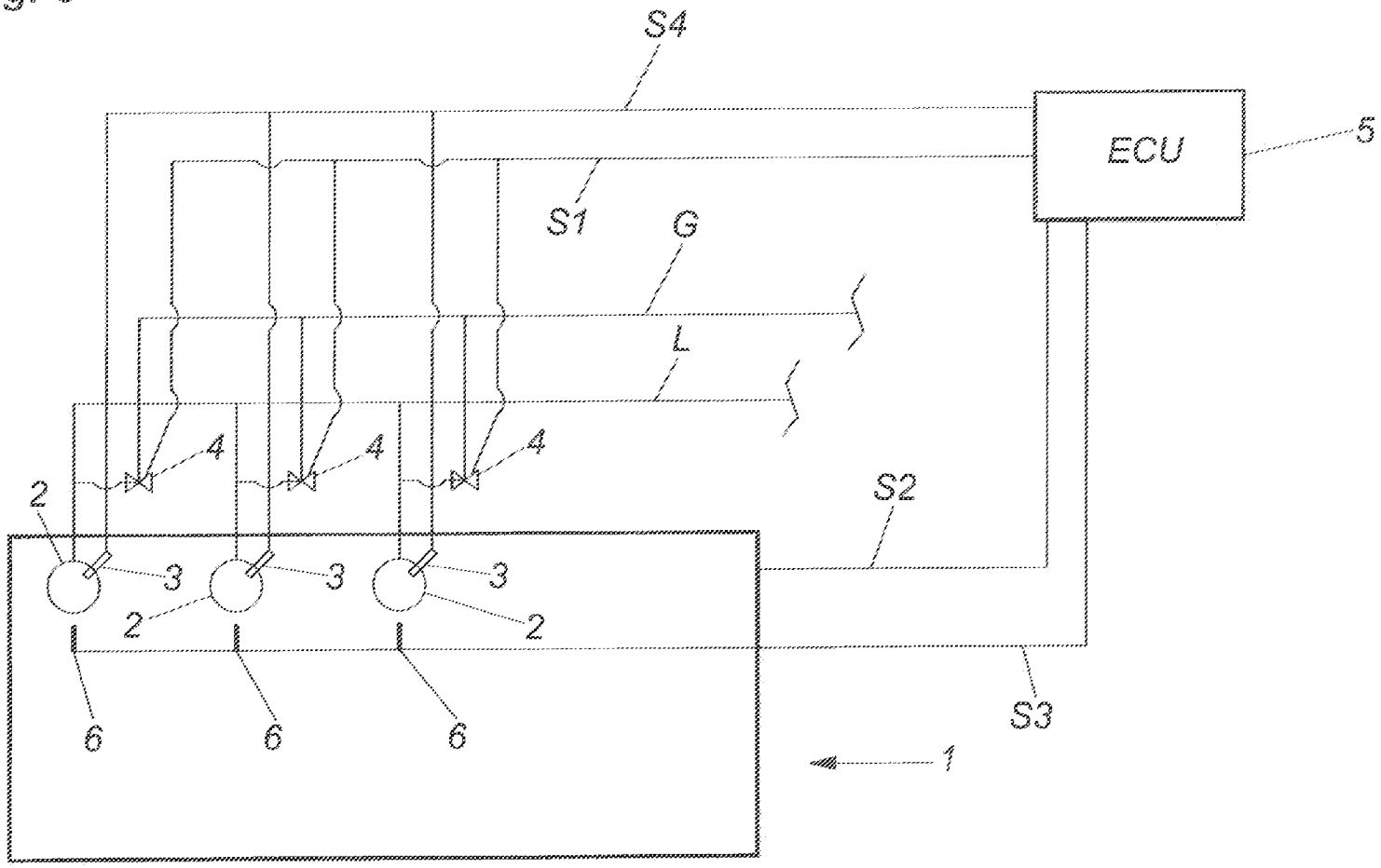

FIG. 3 diagrammatically shows the circuit diagram and line diagram of an internal combustion engine 1, showing ignition devices 3 and fuel introduction devices 4. Here, therefore, there is the possibility of the ignition devices 3 and fuel introduction devices 4 being actuated separately by means of an ignition signal line S4 and a fuel feed signal line S1, respectively.

Figure 4:
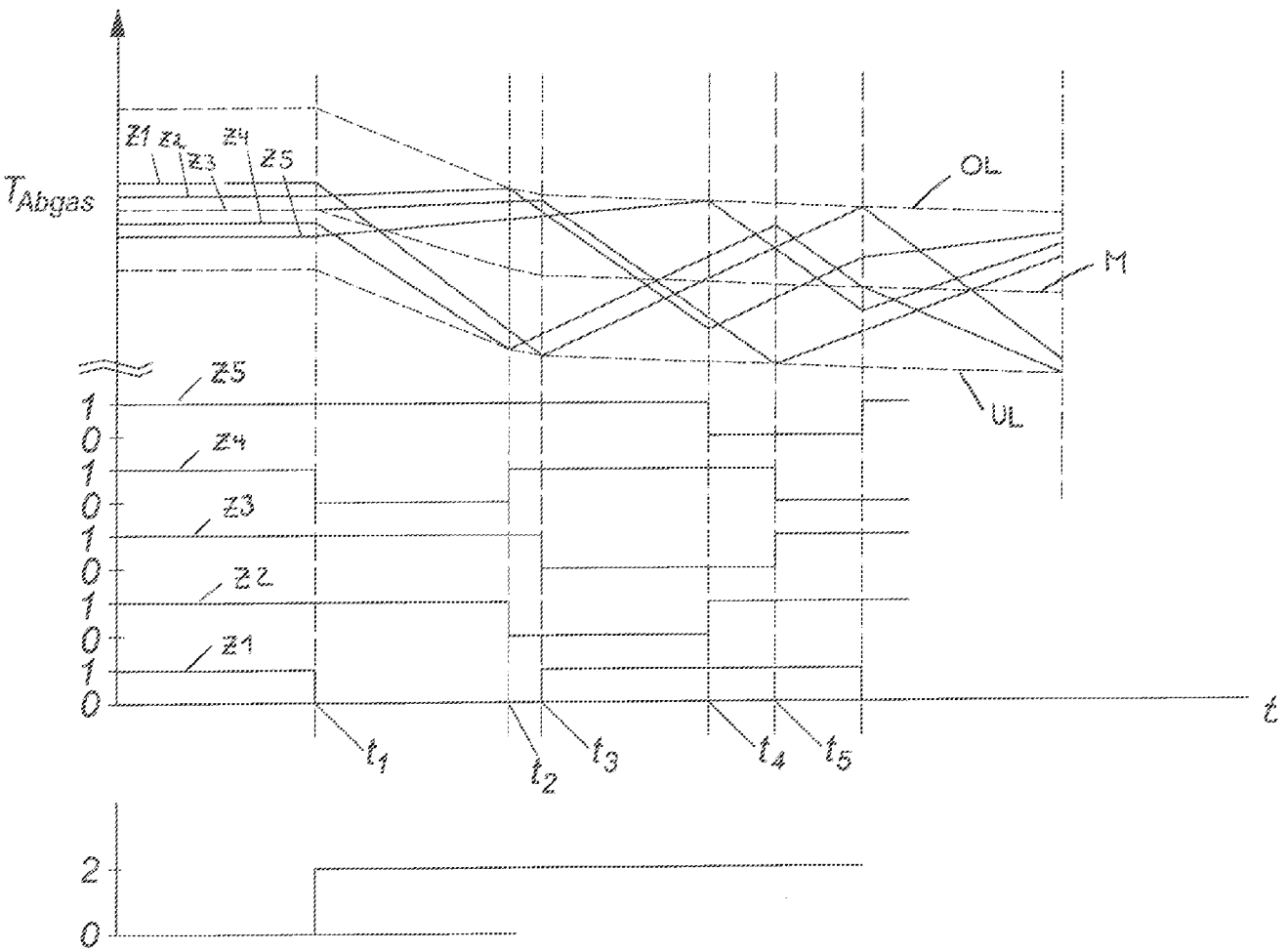

FIG. 4 shows a diagram, time being shown on the X-axis thereof. The Y-axis is interrupted and in the upper part shows the characteristic temperature in any units for each of the cylinders 2 of which five are shown as an example. The five cylinders 2 selected by way of example can be distinguished therein by references Z1 through Z5 and are clearly identified thereby.

Figure 5:
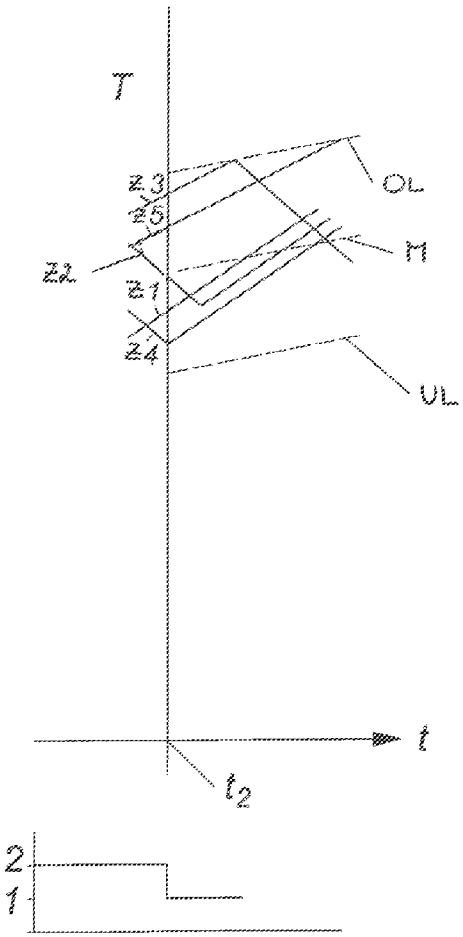

FIG. 5 shows a graph, time (t) being shown on the X-axis and on the Y-axis temperature (T) in any units for each of the cylinders 2 of which five are shown as an example (references Z1 through Z5).

Figure 6:
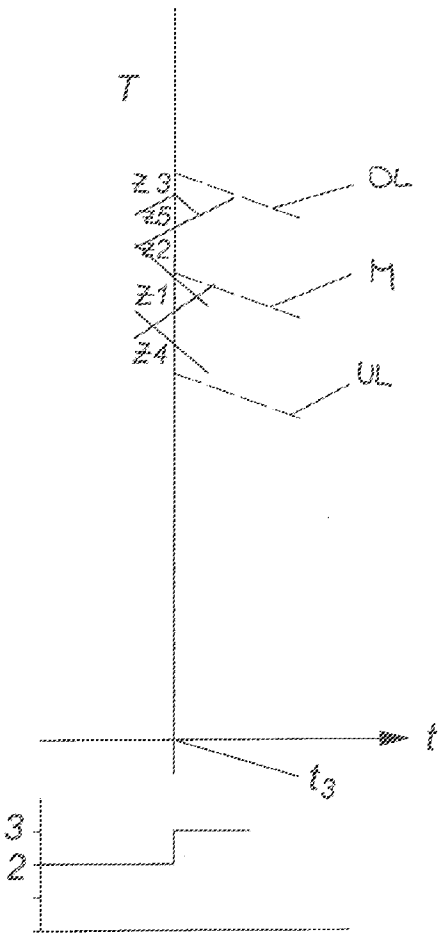

FIG. 6 shows a graph, time (t) being shown on the X-axis and on the Y-axis temperature (T) in any units for each of the cylinders 2 of which five are shown as an example (references Z1 through Z5).

DETAILED DESCRIPTION OF THE INVENTION

In addition, the ignition status for each of the five cylinders 2 Z1 through Z5 is also shown on the Y-axis, wherein a '1' signifies that the cylinder 2 in question experiences ignition in a cycle and a '0' signifies that there is no ignition in a cycle.

A separate plotting beneath the X-axis represents the number of cylinders 2 which are not to experience ignition (established by the open-loop or closed-loop control device 5 in dependence on the power and/or speed requirement of the internal combustion engine 1) in dependence on the time identified on the X-axis. It will be seen that up to the time t1 no cylinders are omitted (zero) and from time t1 two cylinders are intended for non-ignition (illustrated by the number 2).

At time t1, the command for non-ignition is given by the open-loop or closed-loop control device 5. In the present case, this means that the fuel introduction devices 4 of the selected cylinders 2 (in the present case, cylinders No. 1 and No. 4) are not activated so that no fuel is introduced into those cylinders 2 and thus those cylinders 2 do not have ignition in the following cycle. The presetting for non-ignition of two cylinders therefore corresponds to the setting of a baseline pattern which, for example, reflects the currently prevailing power demand on the internal combustion engine 1.

After the time t1, the decision for non-ignition or ignition of the cylinders 2 is no longer implemented by presetting of the baseline pattern, but in dependence on the characteristic temperature of the cylinders 2, that is ascertained by the sensors 6.

Now, implementation of skip firing in dependence on the characteristic temperature of the individual cylinders 2 is to be described by means of the example in FIG. 4:

Firstly, at the time t2, the cylinder identified by the number Z4 falls below the lower limit of the characteristic temperature UL and is therefore intended for ignition in the next cycle by the open-loop or closed-loop control device 5. At the same time, the cylinder identified by the number Z2 is at the highest characteristic temperature, reaches the upper temperature limit OL and therefore does not have ignition in the next cycle; next, the cylinder Z1 reaches the lower limit UL and is therefore intended for ignition in the next cycle and so forth.

It can be clearly seen that, in the selected example, by virtue of the omission of two cylinders 2, the mean of the characteristic temperatures M falls in relation to the condition of complete ignition, that is to say no cylinder 2 is omitted.

The illustrated number of five cylinders 2 is selected only by way of example, in reality, it is possible to provide any number of cylinders, in practice generally between 12 and 24.

FIG. 5, in a diagram similar to FIG. 4, illustrates the situation where, at the time t2, the transition takes place from two cylinders intended for omission (non-ignition) to only one cylinder which is not to involve ignition. It may be necessary, for example, due to an increased power demand, to add a cylinder 2. That cylinder 2 is activated for ignition, that is at the lowest characteristic temperature, in the illustrated example this being the cylinder 2 identified by number Z4. The number of cylinders intended for omission is again shown in a separate graph below the main axis. It will be seen therein that, at the time t2, the status jumps from two cylinders intended for omission to one.

FIG. 6 shows a diagram similar to FIG. 5 for the situation where, at the time t2, the transition occurs from two cylinders 2 to three cylinders 2 which are intended for omission (non-ignition). It may be necessary, for example, due to a reduced power demand, to omit a further cylinder 2. That cylinder 2 is deactivated from ignition, that is at the highest characteristic temperature, in the illustrated example this being the cylinder 2 No. 3. Illustrated in a separate graph beneath the main axis is the fact that, at the time t3, the status jumps from two non-ignition cylinders to three non-ignition cylinders.

Internal combustion engines according to the invention are preferably in the form of, in particular, stationary engines (preferably gas Otto-cycle engines) which are particularly preferably coupled to an electric generator for power generation.

LIST OF REFERENCES USED

1 internal combustion engine
2 cylinder
3 ignition device
4 fuel introduction device
5 open-loop or closed-loop control device
6 sensors of the measuring device for determining the characteristic temperature
G fuel feed line
L air feed line
S1 fuel feed signal line
S2 engine signal line S3 temperature signal line
S4 signal line
T temperature
t time
M mean temperature
OL upper temperature limit
UL lower temperature limit
Z1-Zi identification of selected cylinders

The invention claimed is:

1. An internal combustion engine comprising:

a plurality of cylinders including combustion chambers, wherein an ignition device or a fuel introduction device is associated with each of the combustion chambers, wherein the combustion chambers are adapted for cyclic ignition of fuel, an open-loop or closed-loop control device for actuation or closed-loop control of the ignition devices or the fuel introduction devices, and a plurality of measuring devices, each for detecting a temperature which is characteristic for one of the cylinders, wherein the open-loop or closed-loop control device is adapted for actuation or closed-loop control of the ignition devices or the fuel introduction devices in dependence on signals of the measuring devices such that (i) the ignition device or the fuel introduction device associated with at least one of the cylinders is inactive during at least one cycle in a situation in which the characteristic temperature of at least one of the cylinders reaches or exceeds a predeterminable upper value for actuation or closed-loop control of the at least one of the cylinders, and (ii) the ignition device or the fuel introduction device associated with at least one of the cylinders is active in a situation in which the characteristic temperature of the at least one of the cylinders reaches or falls below a predeterminable lower value for actuation or closed-loop control of the at least one of the cylinders, whereby an even temperature distribution over all of the cylinders is achieved, and wherein the predeterminable upper value or the predeterminable lower value is established based on an average temperature of all of the cylinders.

2. The internal combustion engine as set forth in claim 1, wherein the fuel introduction devices are port injection valves.

3. The internal combustion engine as set forth in claim 1, wherein the fuel introduction devices are variable inlet valves of a variable valve gear.

4. The internal combustion engine as set forth in claim 1, wherein the fuel introduction devices are injectors arranged directly in the cylinders, respectively.

5. The internal combustion engine as set forth in claim 1, wherein the ignition devices are spark ignition devices, corona ignition devices, glow plugs or laser ignition devices.

6. The internal combustion engine as set forth in claim 1, wherein a baseline pattern is stored in an electronic memory of the open-loop or closed-loop control device, in accordance with which the ignition devices or the fuel introduction devices are actuable or regulatable by the open-loop or closed-loop control device in such a way that the ignition device or the fuel introduction device associated with the at least one of the cylinders is inactive during the at least one cycle, and wherein the open-loop or closed-loop control device is adapted, in a first operating mode, for actuation or closed-loop control of the ignition devices or the fuel introduction devices in accordance with the baseline pattern, without taking into account the signals of the measuring devices.

7. The internal combustion engine as set forth in claim 1, wherein, in addition to the signals of the measuring devices, further signals which are characteristic for a rotary speed and a load presetting to the internal combustion engine are fed to the open-loop or closed-loop control device and the open-loop or closed-loop control device is adapted, in dependence on the further signals, to establish what proportion of all of the ignition devices or the fuel introduction devices are active.

8. The internal combustion engine as set forth in claim 1, wherein the open-loop or closed-loop control device is adapted, in the event of failure of one of the signals of the measuring devices, for actuation or closed-loop control of the ignition devices or the fuel introduction devices corresponding to a predetermined number of past cycles.

9. A method of operating an internal combustion engine having a plurality of cylinders including combustion chambers, wherein an ignition device or a fuel introduction device is associated with each of the combustion chambers, wherein the combustion chambers are adapted for cyclic ignition of fuel, the internal combustion engine having an open-loop or closed-loop control device for actuation or closed-loop control of the ignition devices or the fuel introduction devices, and a plurality of measuring devices, each for detecting a temperature which is characteristic for one of the cylinders, wherein the open-loop or closed-loop control device is adapted for actuation or closed-loop control of the ignition devices or the fuel introduction devices in dependence on signals of the measuring devices such that (i) the ignition device or the fuel introduction device associated with at least one of the cylinders is inactive during at least one cycle in a situation in which the characteristic temperature of the at least one of the cylinders reaches or exceeds a predeterminable upper value for actuation or closed-loop control of the at least one of the cylinders, and (ii) the ignition device or the fuel introduction device associated with at least one of the cylinders is active in a situation in which the characteristic temperature of the at least one of the cylinders reaches or falls below a predeterminable lower value for actuation or closed-loop control of the at least one of the cylinders, whereby an even temperature distribution over all of the cylinders is achieved, and wherein the predeterminable upper value or the predeterminable lower value is established based on an average temperature of all of the cylinders.

* * * * *